United States Patent [19]

Simpson

[11] 4,341,346

[45] Jul. 27, 1982

[54] RADIATORS FOR USE IN HOT WATER CENTRAL HEATING SYSTEMS

[75] Inventor: Victor J. Simpson, Walton-on-Thames, England

[73] Assignee: Alcan Aluminium (U.K.) Ltd., London, England

[21] Appl. No.: 173,754

[22] Filed: Jul. 30, 1980

[51] Int. Cl.[3] ..... F24H 3/00

[52] U.S. Cl. ..... 237/70; 165/173

[58] Field of Search ..... 165/165, 173, 175, 149; 237/70

[56] References Cited

U.S. PATENT DOCUMENTS 3,648,768 3/1972 Schöll ..... 165/173

FOREIGN PATENT DOCUMENTS 2441973 11/1976 Fed. Rep. of Germany ..... 165/173
2112275 6/1972 France .
2133846 12/1972 France .
2435013 3/1980 France .
1185359 3/1970 United Kingdom .
1292767 10/1972 United Kingdom .
1406108 9/1975 United Kingdom .
1460112 12/1976 United Kingdom .

*Primary Examiner*—Ronald C. Capossela
*Attorney, Agent, or Firm*—Sherman & Shalloway

[57] ABSTRACT

A radiator for use in hot water central heating systems is constructed from extruded aluminium alloy sections. One finned configuration of section having a tubular duct extending therethrough is used as the heat exchanger which interconnects the fluid flow and return headers. These each incorporate locking flanges which interlock with respective external slots pre-formed in the fins on each side of the heat-exchanger sections. Pressure tight fluid connections between the headers and the duct in each heat-exchanger section are made by double-ended chamfered barrel nipples.

5 Claims, 3 Drawing Figures

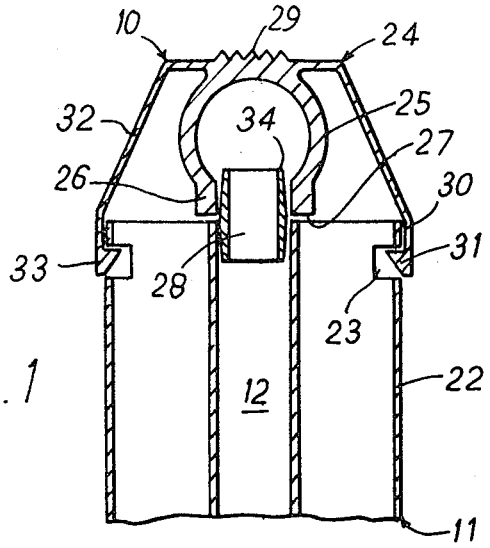
FIG. 1
FIG. 2
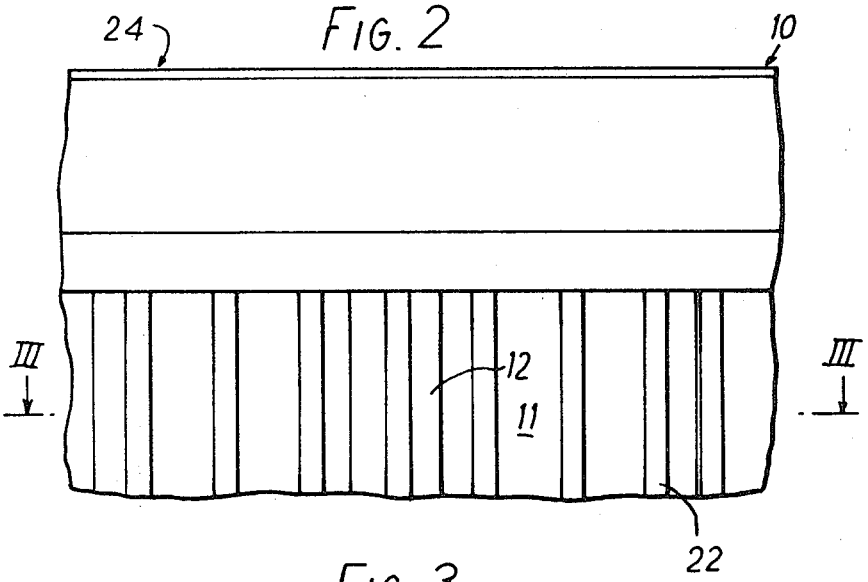
FIG. 3
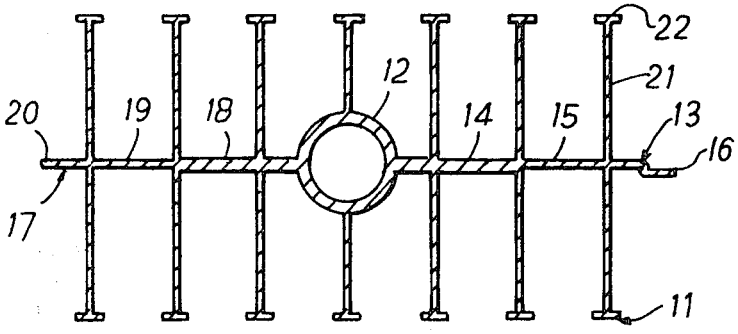

RADIATORS FOR USE IN HOT WATER CENTRAL HEATING SYSTEMS

BACKGROUND OF THE INVENTION (1) Field of the Invention

This invention relates to the construction and manufacture of radiators used in hot water central heating systems.

(2) Description of the Prior Art

UK Pat. No. 1,406,108 describes a radiator construction in which each end of a number of heat-exchanger sections is recessed to accommodate a flow and a return header respectively, the headers being held in place by pairs of opposed wedges which are driven into grooves formed in opposite walls of each recess in the direction of the headers.

It is an object of the present invention to provide a simple, effective and strong radiator construction in which no separate parts are required to hold the headers in position and the headers themselves form a capping of pleasing appearance covering the ends of heat-exchanger sections.

SUMMARY OF THE INVENTION

According to the present invention there is provided a radiator for use in hot water central heating systems and constructed from extruded aluminium or aluminium alloy sections, one configuration of section having at least one tubular duct extending therethrough being used as the heat exchanger which interconnects other configurations of section which form the fluid flow and return headers and which each incorporate a locking flange which interlocks with a respective external slot pre-formed in the side of each heat-exchanger section, the arrangement being such as to result in a rigid assembly with pressure tight fluid connection between the headers and the duct or ducts of each heat-exchanger section.

The construction allows radiators of any desired length or height to be produced from a common extrusion die thus eliminating the need for moulds or dies for each height of radiator. A further advantage of this invention lies in the improved heat output which is in excess of three times that of a flat panel radiator of the same dimensions.

The main feature of this invention is the method by which two sections of extruded metal are interlocked to provide a fluid and pressure tight passage for the fluid within. The sections of extruded metal are arranged so that one section forms the headers and the other section forms the heat exchanger. The header sections interlock with the desired number of heat exchanger sections. The heat exchanger sections are located to link together the flow and return headers which complete the integral water circuit.

The heat exchanger section is so arranged to take full advantage of the differing thermal characteristics between the water to heat exchanger heat transfer coefficient and the air to heat exchanger film coefficient. The construction allows for this to be achieved by arranging longitudinal fins running parallel to the waterway through the heat exchanger. The fins are formed simultaneously with the water tube in the heat exchanger. In a preferred arrangement the surface area of the air-heating surface may be twenty times greater than the surface area inside the tube through which the water passes. Since the longitudinal fins are formed in the same metal as the water tube there is no mechanical or other bond to form a barrier to conducted heat flow within the structure of the heat exchanger. Unlike a conventional panel hot water radiator or cast iron or cast aluminium radiator where the internal surface area in contact with the heating fluid is roughly proportional to the external surface in contact with the air, which latter surface area determines the quantity of heat emission, in the case of this invention both sides of the metal forming the heat exchanger constructed around the fluid path are exposed to dissipate heat to the air. It therefore follows that for a given thickness or weight of material the utilization of both sides greatly reduces the overall weight of basic material required in the heat exchanger to achieve the same unit of heat emission.

The fluid or water headers are constructed from a metal extrusion in the same manner as the heat exchanger section. The header sections consist of a tubular core from which extends the capping profile, the edges of which have a longitudinal lip running parallel to the central tube. The ends of the header may conveniently be internally screwed to form a pipe connection. The internal face of the tubular header is thickened in section to conveniently abut against the end of the heat exchanger profile. A pressure tight connection between the waterway in the header and the waterway in the heat exchanger is achieved by the use of multiple chamfered barrel nipples one end of which presses as an interference fit into the tube formed in the heat exchanger section whilst the other end of the barrel nipple is pressed into suitable holes bored into the header section at right angles to the header tube. The holes bored into the header tube are also an interference fit to the chamfered nipples.

Any desired number of heat exchanger sections of any desired equal length may thus be laid side by side and headers of suitable length placed so that the chamfered barrel nipples engage both the holes bored in the header and the tube formed in the heat exchanger section. The headers may then be pressed together until the nipples are fully engaged and the inner face of the header is in abutment with the end of the heat exchanger profile.

In order that the assembled sections should be retained in the assembled position a slot may be cut across the fins of the heat exchanger section adjacent to each end of the section. This slot may be on either or both sides of the heat exchanger section. It may be formed simultaneously with the operation where the heat exchanger section is cut to required lengths. It now follows that the taper lip on the edge of the capping profile which is an integral part of the header previously described is adjacent to the slots formed into the ends of the heat exchanger section. The lip is then pressed into the slots which are intersected at right angles. The lip thus forms a detent in the slots in the ends of the heat exchanger sections thus permanently locking the assembly together in such a manner that the load of any hydrostatic pressure within the waterway is carried by the detent engaged in the slots of the heat exchanger section. This feature removes any axial load acting on the taper nipples.

Assembly as described can be carried out at high speed with the minimum of skill.

BRIEF DESCRIPTION OF THE DRAWINGS

FIG. 1 is a partial transverse vertical section through a hot-water radiator constructed in accordance with the invention;

FIG. 2 is a partial side elevation of the radiator of FIG. 1; and,

FIG. 3 is a section on the line III—III of FIG. 2.

DETAILED DESCRIPTION OF THE INVENTION

An embodiment of the invention will now be described by way of example, with reference to the accompanying drawings above described.

As shown in the drawings a hot water radiator 10 constructed in accordance with the invention comprises a series of heat-exchange panels 11 extruded from aluminium and having a central circular waterway 12 from diametrically opposed sides of which extend two webs; the web 13 having a root portion 14 which is thicker than an outer portion 15 and terminating in an off-set extremity 16 and the other web 17 having corresponding portions 18 and 19 but terminating in a plain extremity 20 which is slightly shorter than the extremity 16.

From each side of each of the webs 13 and 17 project three identical fins 21 which each terminate in a transverse flange 22. A slot 23 is formed near each end of each flange 22 and of each fin 21 to define channel running parallel to the end faces of the panels 11.

The heat-exchange panels 11 are capped at each end by identical headers, only the upper header 24 being shown in the drawings. As shown in FIG. 1, the header 24 comprises a generally circular core 25 having a thickened base portion 26 with a flat face 27 which is drilled at intervals to form a series of holes, one of which, indicated by the reference 28, is shown in FIG. 1. The upper outer surface of the wall of the core 25 is formed with a series of decorative serrations 29 and from the core 25, at a point near one end of the serrated portion, there extends a capping flange 30 terminating in a tapered internal lip 31. A similar flange 32 extends from near the other end of the serrated portion and terminates in a lip 33, the flanges 30 and 32 together having generally an outwardly divergent channel section within which lies the core 25, the distance between the lips being, before assembly, slightly less than the thickness of the panels 11.

A chamfered barrel nipple 34 is inserted in an interference fit into each end of each waterway 12.

To form the radiator 10 as many panels 11 of any desired length and as are necessary to form the desired width are laid side by side so that the flange 16 of one panel 11 overlies the terminal portion 20 of an adjacent panel 11. The slots 23 may be formed at the same time as the panels 11 are cut to length.

Two corresponding lengths of header extrusion are then cut to form the upper header 24 and the lower header, the core 25 of each header being tapped at each end to receive conventional flow and return connections, plugs or bleeder valves. "Loctite" (Trademark) or similar jointing compound is then applied to the exposed portions of the chamfered nipples 34 and a header placed against each end of the juxtaposed panels 11, with the nipples 34 being received in the holes 28, the previously-mentioned intervals between which correspond to the intervals between the nipples 34 projecting from the assembled panels 11.

The headers are then pressed together so that the nipples 34 are fully received, also in an interference fit, in the holes 28 and then the flanges 30 and 32 are clamped together so that the lips 31 and 33 are received in the respective channels defined by the slots 23. The consequent detent formed by the engagement of the flat inner face of the lips 31 and 32 with the outer side wall of the respective slots 23 ensures that the headers are positively interlocked and strongly resist any force tending to prise them away from the panels 11 and any axial load on the nipples 34 is relieved.

The above described construction allows a radiator of high thermal efficiency to be formed of aluminium extrusions which have a characteristic of requiring only about half the weight of metal required for a die cast aluminium radiator of the same heat output or approximately one fifth the weight of a conventional steel panel radiator of the same heat emission. The resultant reduction in material required for a given heat minimum results in considerable cost advantage.

Each panel 11 could if desired have two or more waterways each pair being joined by an integral web.

What is claimed is:

1. A radiator for use in hot water central heating systems and constructed from extruded aluminium or aluminium alloy section, one configuration of section having at least one tubular duct extending therethrough being used as the heat exchanger which interconnects other configurations of section which form the fluid flow and return headers and which each incorporate a locking flange which interlocks with a respective external slot pre-formed in the side of each heat-exchanger section, the flow and return headers being drilled at intervals to coincide with the position of the tubular duct or ducts in each heat-exchanger section and one end of a double-ended chamfered barrel nipple being pressed as an interference fit into the end of said duct and the other end of the chamfered nipple being pressed as an interference fit into the corresponding hole drilled into the header at right angles to the cored flow path, thus forming a rigid assembly with a fluid pressure tight connection at each joint between the heat-exchanger duct and the headers.

2. A radiator according to claim 1, in which the flow and return headers each incorporate two locking flanges which interlock with respective slots preformed in opposite sides of the heat-exchanger.

3. A radiator according to claim 1, in which the slots are pre-formed at each end of fins which are provided on at least one side of the heat exchanger, each slot being engaged by the end portion of a respective flange.

4. A radiator according to claim 3, in which said end portion is an internal lip which is arranged for positive engagement with a wall of the slot to resist any force urging the header away from the heat-exchanger.

5. A radiator according to claim 1, in which a face of each header abuts the corresponding end face of the heat-exchanger.

* * * * *